US006820604B2

(12) United States Patent
Chong et al.

(10) Patent No.: US 6,820,604 B2
(45) Date of Patent: Nov. 23, 2004

(54) SYSTEM WITH AN OFFSET LEARN FUNCTION AND A METHOD OF DETERMINING A THROTTLE-POSITION SENSOR OFFSET

(75) Inventors: Carolyn Chong, Wixom, MI (US); John Wathen, Fowlerville, MI (US)

(73) Assignee: Robert Bosch Corporation, Broadview, IL (US)

( * ) Notice: Subject to any disclaimer, the term of this patent is extended or adjusted under 35 U.S.C. 154(b) by 0 days.

(21) Appl. No.: 10/248,331

(22) Filed: Jan. 9, 2003

(65) Prior Publication Data

US 2004/0134463 A1 Jul. 15, 2004

(51) Int. Cl.[7] ..... F00D 41/00
(52) U.S. Cl. ..... 123/680; 123/683
(58) Field of Search ..... 123/680, 683, 123/406.45, 406.47, 399

(56) References Cited

U.S. PATENT DOCUMENTS

| | | | | | |
|---|---|---|---|---|---|
| 4,418,673 | A | * | 12/1983 | Tominari et al. | 123/478 |
| 4,592,322 | A | * | 6/1986 | Murakami et al. | 123/361 |
| 4,922,425 | A | | 5/1990 | Mack et al. | |
| 5,003,948 | A | * | 4/1991 | Churchill et al. | 123/352 |
| 5,056,022 | A | | 10/1991 | Witkowski et al. | |
| 5,079,946 | A | | 1/1992 | Motamedi et al. | |
| 5,157,956 | A | | 10/1992 | Isaji et al. | |
| 5,204,816 | A | | 4/1993 | Wright et al. | |
| 5,220,828 | A | | 6/1993 | Sodeno et al. | |
| 5,384,707 | A | * | 1/1995 | Kerns et al. | 701/114 |
| 5,568,386 | A | | 10/1996 | Sugiura et al. | |
| 5,598,825 | A | * | 2/1997 | Neumann | 123/478 |
| 5,677,482 | A | | 10/1997 | Gee et al. | |
| 5,686,840 | A | | 11/1997 | Johnson | |
| 5,966,305 | A | | 10/1999 | Watari et al. | |
| 6,112,724 | A | | 9/2000 | Kotwicki et al. | |
| 6,230,094 | B1 | | 5/2001 | Ohashi et al. | |
| 6,237,564 | B1 | | 5/2001 | Lippa et al. | |
| 6,351,704 | B1 | | 2/2002 | Koerner | |
| 6,397,816 | B1 | * | 6/2002 | Pursifull | 123/399 |
| 6,510,839 | B1 | * | 1/2003 | Pursifull | 123/399 |

OTHER PUBLICATIONS

Robert Bosch Corporation, Service and Diagnotstics Training Seminar for Kohler Engines, Command CH26 Electronic Fuel Injection System, Sep. 16, 1997.

* cited by examiner

*Primary Examiner*—John T. Kwon
(74) *Attorney, Agent, or Firm*—Michael Best & Friedrich LLP

(57) ABSTRACT

A fuel injection system in an engine. The system includes a throttle body having a throttle valve, a first sensor, and a control unit coupled to the first sensor. The first sensor measures a sensed throttle valve angle and provides a first output corresponding to the sensed throttle valve angle. The control unit is operable to receive the output generated by the first sensor, operable to compute an expected throttle valve angle, operable to determine an offset between the expected throttle valve angle and the sensed throttle valve angle, operable to determine a corrected throttle valve angle, and operable to compute fueling calculations based on the corrected throttle valve angle. The corrected throttle valve angle is based on the offset and the sensed throttle valve angle.

55 Claims, 5 Drawing Sheets

20
55
35
30
58
26
58
26
25
28

SYSTEM WITH AN OFFSET LEARN FUNCTION AND A METHOD OF DETERMINING A THROTTLE-POSITION SENSOR OFFSET

BACKGROUND OF INVENTION

The present invention relates to fuel injection systems and, more specifically, to electronic fuel injection systems.

Typically, a throttle valve controls the air flow into an intake manifold in an engine. In many fuel injection (FI) systems, the air flow into the engine is determined indirectly using coordinates defined by a throttle valve angle and the speed at which the engine is operating. For these systems to function correctly, the relationship between the throttle valve angle and the actual flow area within the housing of the throttle valve must be maintained within very close tolerances. In many FI systems, the throttle valve angle is measured by a throttle position sensor (TPS). In many systems, the TPS outputs an electrical resistance value which directly relates to the sensed throttle angle.

In existing systems, the TPS needs to be manually adjusted when installed so that at a physical or measured throttle angle, the actual airflow matches the airflow expected or calculated by a control unit at that same electronically measured or derived throttle angle. In other words, the TPS has to be adjusted so that the ignition and fuel maps residing within the control unit are aligned with the hardware.

Conventionally, TPS adjustment is performed during assembly of the throttle body. First, the TPS is loosely installed on the throttle body. The throttle valve is adjusted to provide a predetermined airflow on an air-flow bench. The TPS is physically rotated to achieve the desired electrical resistance for that airflow and permanently attached to the throttle body. When this installation method is used, the throttle body and the TPS must be serviced as a unit.

A problem associated with the conventional installation method is that since dealers in the field typically do not have access to air flow benches, a complicated service procedure must be used if the control unit, TPS, or throttle body needed to be replaced. Further, many dealers are not able to perform the procedure correctly due to its complexity. An incorrectly installed TPS can greatly effect fueling calculations, especially at small throttle valves angles. Improper or incorrect fueling calculations reduce engine efficiency.

SUMMARY OF INVENTION

In one embodiment, the invention provides a fuel injection system that performs an automatic adjustment function for the TPS and throttle valve position. The function can be performed while the engine is intact and running. The engine runs in an idle mode and includes an exhaust manifold and a fuel injection system. The fuel injection system includes a control unit, a throttle valve, and at least one sensor providing an output. The fuel injection system is operable to perform in a closed-loop mode.

In another embodiment, the invention provides a method of calculating an offset of a throttle-position sensor in an engine. The method includes operating the engine in idle mode, operating the electronic fuel injection system in closed-loop mode, computing an expected angle of the throttle valve, and obtaining a first output from the plurality of sensors. The method also includes determining an actual angle of the throttle valve using the output from the at least one sensor, determining an offset between the expected angle of the throttle valve and the actual angle of the throttle valve and adding the offset to the actual angle of the throttle valve to generate a corrected angle of the throttle valve.

In another embodiment, the invention provides a method of performing fueling calculations for a fuel injection system in an engine. The fuel injection system is capable of operating in a plurality of functioning modes including a closed-loop mode. The fuel injection system has a control unit, a throttle valve, an exhaust manifold, and a plurality of sensors providing outputs. The engine is capable of operating at stoichiometry and capable of operating in a plurality of operating modes including an idle mode.

The method includes computing an expected angle of the throttle valve, determining a functioning mode of the fuel injection system, determining an operating mode of the engine, and obtaining a first output from a first sensor in the plurality of sensors when the fuel injection system is operating in the closed-loop mode and when the engine is operating in the idle mode. The method also includes determining an actual angle of the throttle valve using the first output from the first sensor, determining an offset between the expected angle of the throttle valve and the actual angle of the throttle valve and adding the offset to the actual angle of the throttle valve to result in a corrected angle of the throttle valve. The method further includes computing fueling calculations based on the corrected angle of the throttle valve.

In another embodiment, the invention provides a fuel injection system in an engine. The system includes a throttle body having a throttle valve and a plurality of sensors generating outputs. The plurality of sensors include a first sensor measuring a sensed throttle valve angle and providing an output corresponding to the sensed throttle valve angle. The system also includes an electronic control unit coupled to the plurality of sensors and that is operable to receive outputs generated by the plurality of sensors. The electronic control unit includes a first computational module operable to determine a theoretical throttle valve angle, a second computational module operable to determine a measured throttle valve angle based on the output corresponding to the sensed throttle valve angle and a third computational module operable to determine an offset between the theoretical throttle valve angle and the measured throttle valve angle. The control unit also includes a summing module operable to add the offset to the measured throttle valve angle to produce a corrected throttle valve angle, a fueling computational module operable to determine fueling calculations based on the corrected throttle valve angle and an analyzing module operable to analyze the outputs from the plurality of sensors.

In another embodiment, the invention provides a fuel injection system in an engine. The system includes a throttle body having a throttle valve, a first sensor, and a control unit coupled to the first sensor. The first sensor measures a sensed throttle valve angle and provides a first output corresponding to the sensed throttle valve angle. The control unit is operable to receive the output generated by the first sensor, operable to compute an expected throttle valve angle, operable to determine an offset between the expected throttle valve angle and the sensed throttle valve angle, operable to determine a corrected throttle valve angle, and operable to compute fueling calculations based on the corrected throttle valve angle. The corrected throttle valve angle is based on the offset and the sensed throttle valve angle.

In a further embodiment, the invention provides a fuel injection system in an engine. The system includes a first sensor that measures an engine parameter and provides a first output corresponding to a sensed value of the engine parameter. The system also includes a control unit coupled to the first sensor. The control-unit is operable to receive the output generated by the first sensor, operable to compute an expected value of the engine parameter, operable to determine an offset between the expected value of the engine parameter and the sensed value of the engine parameter, operable to determine a corrected value of the engine parameter, and operable to compute fueling calculations based on the corrected value. The corrected value of the engine parameter is based on the offset and the sensed value of the engine parameter.

Other features and advantages of the invention will become apparent by consideration of the detailed description and accompanying drawings.

Figure 1:
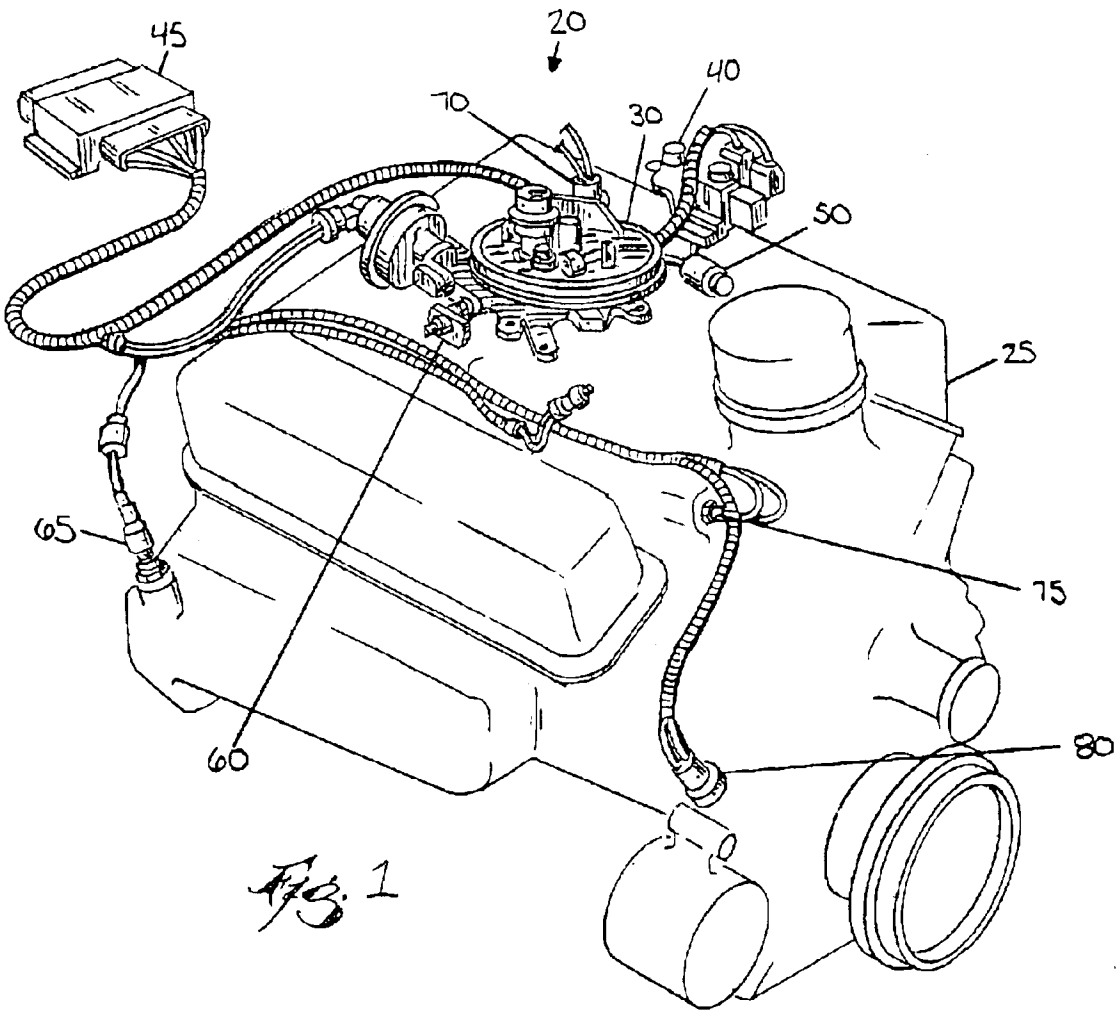
FIG. 1 is a perspective view of an empty fuel injection system on an engine according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of including, comprising, or having and variations thereof herein is meant to encompass the items listed thereafter and equivalents thereof as well as additional items. The terms mounted, connected, and coupled are used broadly and encompass both direct and indirect mounting, connecting, and coupling. Further, connected and coupled are not restricted to physical or mechanical connections or couplings.

In addition, it should be understood that embodiments of the invention include both hardware and electronic components or modules that, for purposes of discussion, may be illustrated and described as if all components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

DETAILED DESCRIPTION

Figure 2:
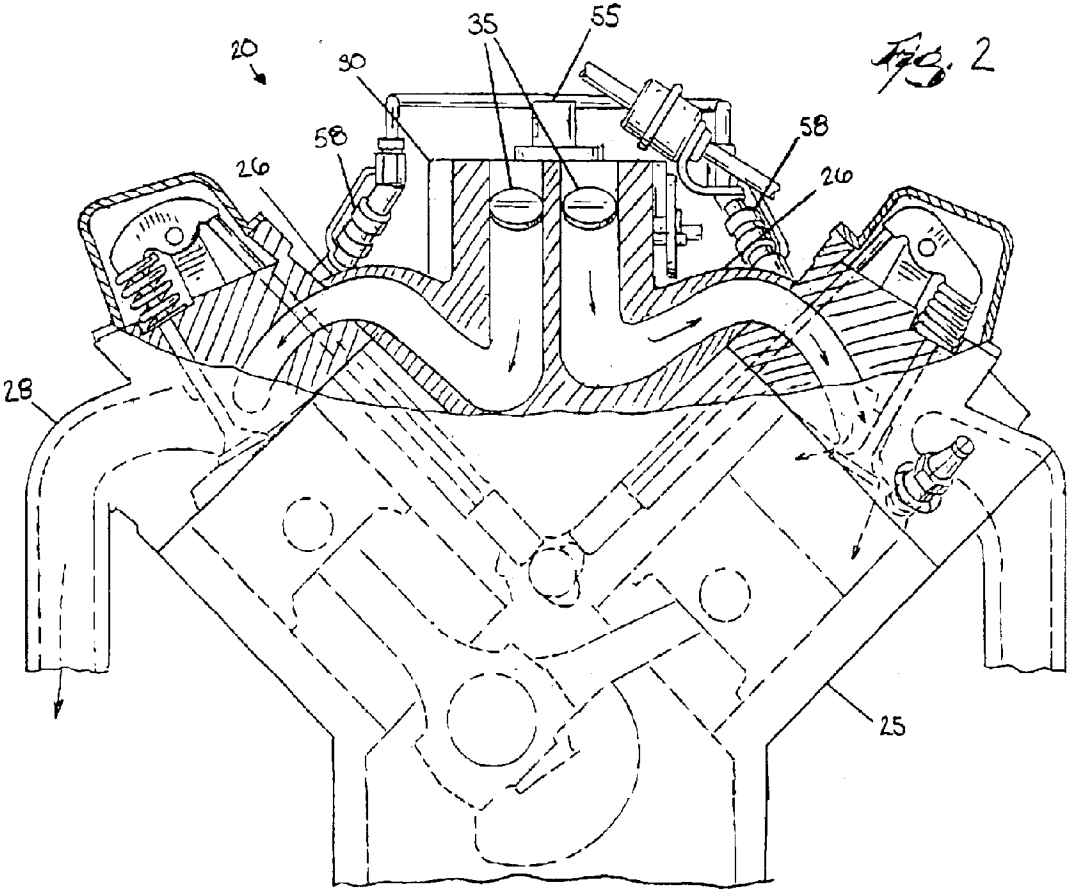
FIG. 2 is partial cross-sectional view of a fuel injection system on an engine according to one embodiment of the invention.
Figure 3:
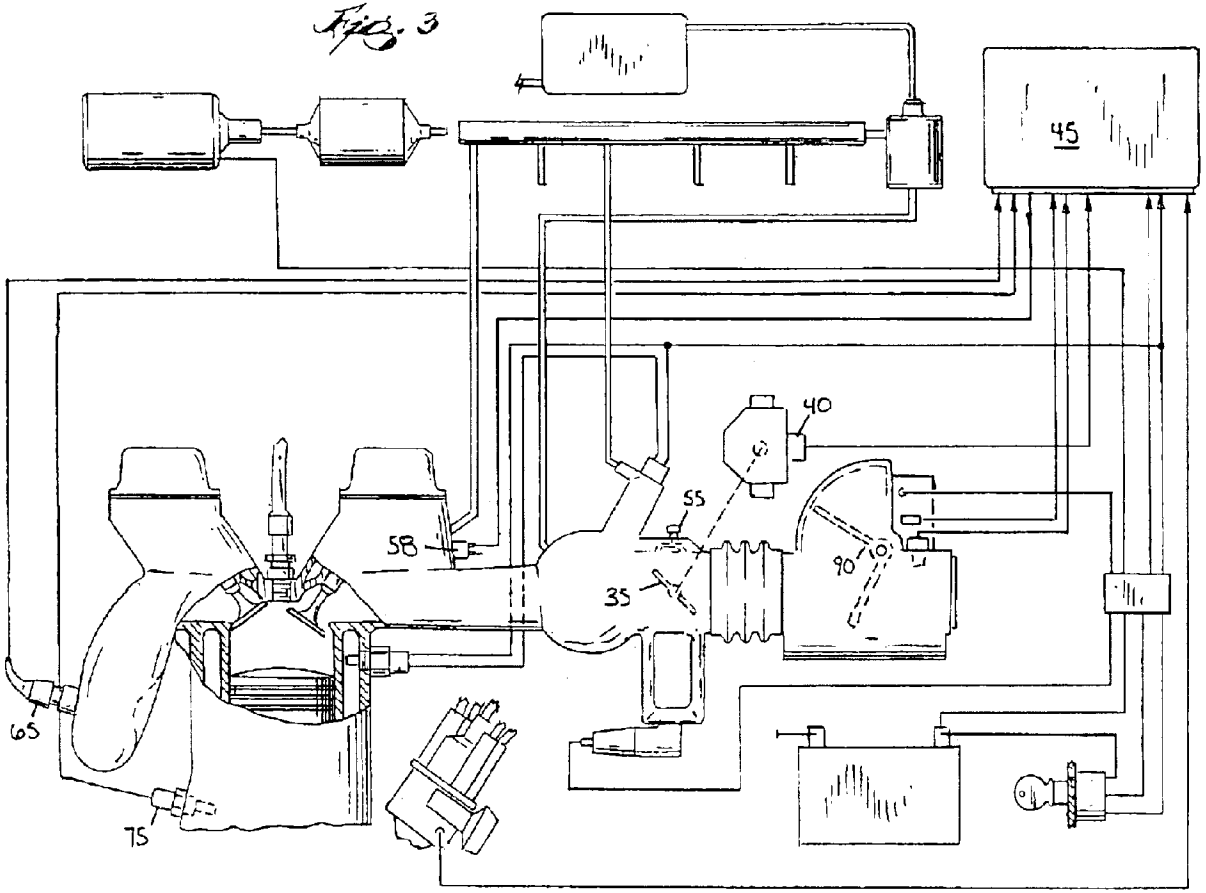
FIG. 3 is a schematic view of the fuel injection system shown in FIG. 1.

FIGS. 1 and 2 illustrate an exemplary fuel injection system 20. FIG. 3 schematically illustrates the fuel injection system 20 and other components in a vehicle. Similar elements shown in the figures are referenced with the same reference number.

Referring to FIGS. 1–3, the fuel injection system 20 is designed to be used with an engine 25, which is shown in partial detail in FIGS. 1 and 2 to avoid unnecessary complexity. The engine 25 includes an intake manifold 26 and an exhaust manifold 28. The intake manifold 26 receives air and fuel to produce an air/fuel mixture. The exhaust manifold 28 receives the exhaust or emission that results from the combustion of the air/fuel mixture in the engine cylinders. The fuel injection system 20 may be a single-point injection system, a multi-point injection system, an indirect injection system, or a direct injection system. In the embodiment shown, the fuel injection system 20 is an electronic fuel injection (EFI) system.

The system 20 includes a throttle body 30 having at least one throttle valve 35. As shown in FIG. 2, the throttle body 30 includes two throttle valves 35. In some embodiments, the throttle valve 35 controls the air flow into the intake manifold 26 in the engine 25. In some embodiments, the throttle valve 35 is a disc-like valve. In other embodiments, the throttle valve 35 can be of another shape and/or size. In the embodiment shown, the throttle valve 35 is positioned within the throttle body 30 and can rotate within the throttle body 30 between a fully closed position and a fully open position. In some embodiments, the fully closed position for the throttle valve 35 is when the throttle valve 35 is in a position that allows substantially no air to enter the intake manifold 26, and the fully open position for the throttle valve 35 is when the throttle valve 35 is in a position that substantially allows the most air to enter the intake manifold 26. Rotating the throttle valve 35 to a position between the fully closed position and the fully open position creates a throttle valve angle measured relative to the fully closed position. The angle of the throttle valve 35 can vary from the fully closed position to the fully open position.

In the embodiment shown, the system 20 also includes a throttle valve positioner or throttle valve switch 40. The throttle valve switch 40 opens, closes and/or positions the throttle valve 35 at a specified throttle valve angle. The throttle valve switch 40 is controlled by a control unit 45, which will be discussed more fully below. In some embodiments, the throttle valve switch 40 is controlled by an actuator 50, which in turn is controlled by the control unit 45.

In some embodiments, the system 20 also includes an idle speed control or an idle control valve 55. The idle control valve 55, in one embodiment, is a solenoid-operated valve that regulates or maintains the idle speed of the engine 25. Opening or closing the valve 55 causes the idle speed of the engine to increase or decrease, respectively.

The system 20 also includes fuel injector 58 for dispensing fuel into the intake manifold 26 of the engine 25. As shown in FIG. 2, the system 20 includes two fuel injectors 58. In some embodiments, the fuel injector 58 is a coil or solenoid operated fuel valve.

The system 20 also includes a plurality of sensors. In some embodiments, each sensor is capable of providing data or an output that corresponds to a sensed engine or fuel injection system parameter or condition. In the embodiment shown, the plurality of sensors of the system 20 includes a throttle position sensor (TPS) 60. The TPS 60 measures the position of the throttle valve 35. In some embodiments, the TPS 60 includes a variable resistor. As the throttle valve 35 opens for more power and closes for less power, the resistance of the variable resistor in the TPS 60 varies to correspond to the position of the throttle valve 60. In the embodiment shown, the TPS 60 indicates an angle at which the throttle valve 35 is opened. In some embodiments, the angle is measured or detected relative to the fully closed position of the throttle valve 35.

In the embodiment shown, the plurality of sensors also includes an exhaust gas sensor or oxygen sensor 65. The oxygen sensor 65 measures the oxygen content in the exhaust manifold 28 of the engine 25 as a way to determine the combustion efficiency of the engine 25. In some embodiments, the oxygen sensor 65 outputs a signal or voltage that varies with the amount of oxygen present in the exhaust manifold 28. A lean air-fuel mixture or an increase in oxygen in the exhaust manifold 28 causes the oxygen sensor 65 to produce a low output voltage. A rich air-fuel mixture or a decrease in oxygen in the exhaust manifold 28 produces a high output voltage. In some embodiments, corrections can be made to the air-fuel mixture in order for the engine to perform at maximum efficiency or stoichiometry. In some embodiments, the oxygen sensor 65 is a Bosch Lambda sensor. The output signal of the Lambda sensor provides an indication of instantaneous air-fuel mixture composition and also an indication of any changes in the air-fuel mixture. The voltage characteristic of the Lambda sensor output is a relatively low voltage output when a lean mixture is detected and jumps to a relatively larger voltage output when a rich mixture is detected. The voltage characteristic also includes a steep inflection point when the engine operates at or near stoichiometry.

In some embodiments, the plurality of sensors further includes a temperature sensor 70, an engine temperature sensor 75, a crankshaft position sensor 80, an exhaust gas recirculation (EGR) valve position sensor 85, an airflow sensor 90, and a manifold pressure sensor (not shown). In various embodiments, the system 20 may include more or less sensors than described above. In further embodiments, the plurality of sensors in the system 20 includes different sensors measuring similar or different engine and/or fuel injection system parameters.

As noted, in the embodiment shown, the system 20 includes control unit 45, which controls the operation of the system 20. In some embodiments, the control unit 45 is a computer or a processor. In some embodiments, the control unit 45 operates in a closed-control loop. When operating in the closed-control loop, for example, the control unit 45 receives information from the sensors and can control and/or modify operation of the system 20 based on the feedback provided by the sensors. When not operating in the closed-control loop, the control unit 45 does not analyze any feedback provided by the sensors. When the embodiments are implemented using currently available sensors, the outputs provided by the sensors may not be accurate upon engine and system start. In some embodiments, the engine 25 typically needs to run for a predefined amount of time or warm-up before the sensors can measure at a satisfactory accuracy.

Figure 4:
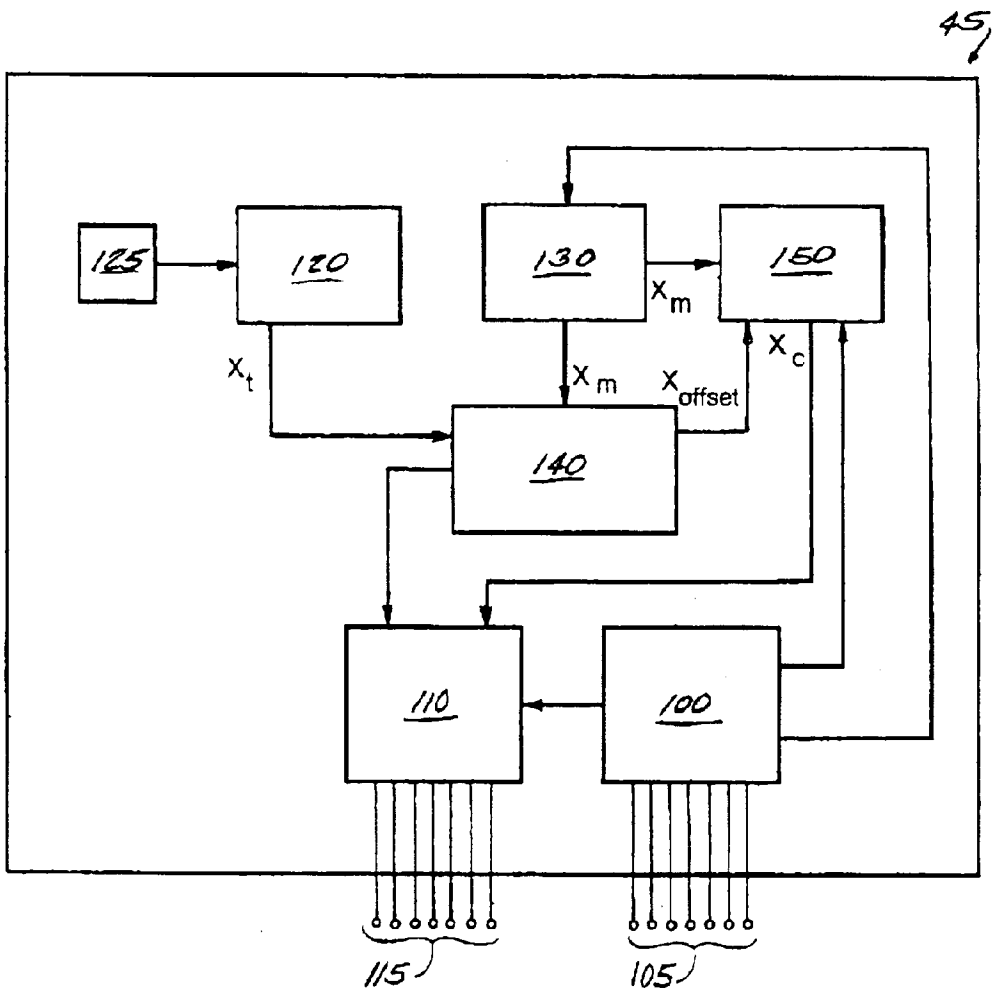
FIG. 4 is a schematic diagram of an electronic control unit suitable for use in a fuel injection system embodying the invention.

FIG. 4 schematically illustrates the control unit 45. As represented or modeled in FIG. 4, the control until 45 includes various computational modules that perform certain functions to control and maintain operation of the system 20. In one embodiment, the modules are implemented in software that may be stored in memory internal to the control unit 45 or on other memory (not shown), such as on an EEPROM. The software may be implemented as one or more programs linked or associated with each other or use one program having multiple routines, functions, objects or methods to implement all of the functionality associated with the modules described.

As should be apparent to those of ordinary skill in the art, information may be communicated using wires or other electrical connections, via wireless links, optical links, or through programmatic tools such as parameter passing, read instructions, write instructions, etc. In the embodiment shown, the control unit 45 includes an analyzing module 100. The analyzing module 100 is coupled to the plurality of sensors for receiving and sending information from and to the sensors. As shown in FIG. 4, the analyzing module 100 receives data from a first plurality of ports 105. In some embodiments, each port 105 electrically connects to a dedicated sensor and each port 105 is an input/output port. In most embodiments, the analyzing module 100 receives the outputs generated by the plurality of sensors through the first plurality of ports 105 and analyzes the collected data to control the operation of the system 20. In some embodiments, the analyzing module 100 determines the operating mode of the engine 25, such as an accelerating mode, idle mode, etc. Also, in some embodiments, the analyzing module 100 determines whether the engine 25 and system 20 is able to operate in the closed-control loop.

In the embodiment shown, the control unit 45 also includes a calculation module 110. In this embodiment, the calculation module 110 is a fueling calculation module 110 which performs sparking and fueling calculations, such as monitoring and/or controlling the amount of fuel injected into the intake manifold 26 by the fuel injectors 58. In some embodiments, the calculation module 110 calculates airflow into the intake manifold 26 based on theoretical or expected throttle angles. In some embodiments, the fueling calculation module 110 adjusts the sparking and/or fueling calculations based on feedback from at least one sensor. In the embodiment shown, the fueling calculation module 110 also adjusts fueling and/or sparking calculations based on adjustments made regarding the output of the TPS 60, as will be more fully discussed below. In other embodiments, the calculation module 110 performs other calculations for manipulating or controlling other actuators or valves in the system 20. For example, the calculation module 110 controls the throttle valve switch 40. The calculation module 110, thus, is able to maintain and control a precise idling speed despite variations in engine temperature or other various factors.

As shown in FIG. 4, the calculation module 110 connects to a second plurality of ports 115. In some embodiments, each port 115 connects to a dedicated switch, valve or actuator. In most embodiments, the calculation module 110 provides commands or signals to the various switches or actuators through the second plurality of ports 115. In some embodiments, the commands or signals are generated by the calculations performed by the calculation module 110.

Still referring to FIG. 4, the control module 45 also includes a first computational module 120, a second computational module 130, a third computational module 140 and a summing module 150. In some embodiments, these computational modules 120, 130, 140 and 150 perform various steps in one or more automatic adjustment functions. The automatic adjustment functions are performed to adjust an engine or fuel injection parameter, x, in order to improve the operation of the system 20. In some embodiments, the function is performed automatically once the control unit 45 senses that the engine 25 and fuel injection system 20 are operating in a closed loop mode. Also in some embodiments, the function is not performed unless the engine 25 is operating at idle.

In the illustrated embodiment, the first computational module 120 derives an expected or theoretical engine parameter value, $x_t$, based on predetermined characteristics programmed or stored in a memory 125 of the control unit 45. In some embodiments, the first computational module 120 is implemented in software and calculates the theoretical value, $x_t$, for a particular engine or fuel injection parameter, x. Other modules discussed herein may also be implemented in software.

The second computational module 130, in the illustrated embodiment, determines a sensed or measured engine parameter, $x_m$, as sensed by at least one sensor. The second computational module 130 receives one or more sensor outputs from the analyzing module 100. In some embodiments, the module 130 determines the measured parameter, $x_m$, based on multiple outputs from a single or multiple sensors. In other embodiments, the second computational module 130 is included in the analyzing module 100 or the analyzing module 100 is capable of determining the measured parameter, $x_m$, based on a output or outputs generated by one or more sensors.

In the embodiment shown, the third computational module 140 receives the theoretical or expected value, $x_t$, from the first computational module 120 and receives the measured value, $x_m$, from either the second computational module 130 or the analyzing module 100. The third computational module 140 determines an offset, $x_{offset}$, between the expected value, $x_t$, and the measured value, $x_m$.

The summing module 150, in the embodiment shown, calculates an adjusted or corrected value, $x_c$, for the engine or fuel injection parameter, x. In this embodiment, the summing module 150 receives the offset, $x_{offset}$, determined by the third computational module 140 and receives the measured value, $x_m$, from the second computational module 130. The summing module 150 adds the offset, $x_{offset}$, to the measured value, $x_m$, to produce the corrected value, $x_c$. In some embodiments, the summing module 150 sends the corrected value, $x_c$, to the calculation module 110 for use in its calculations.

Figure 5:
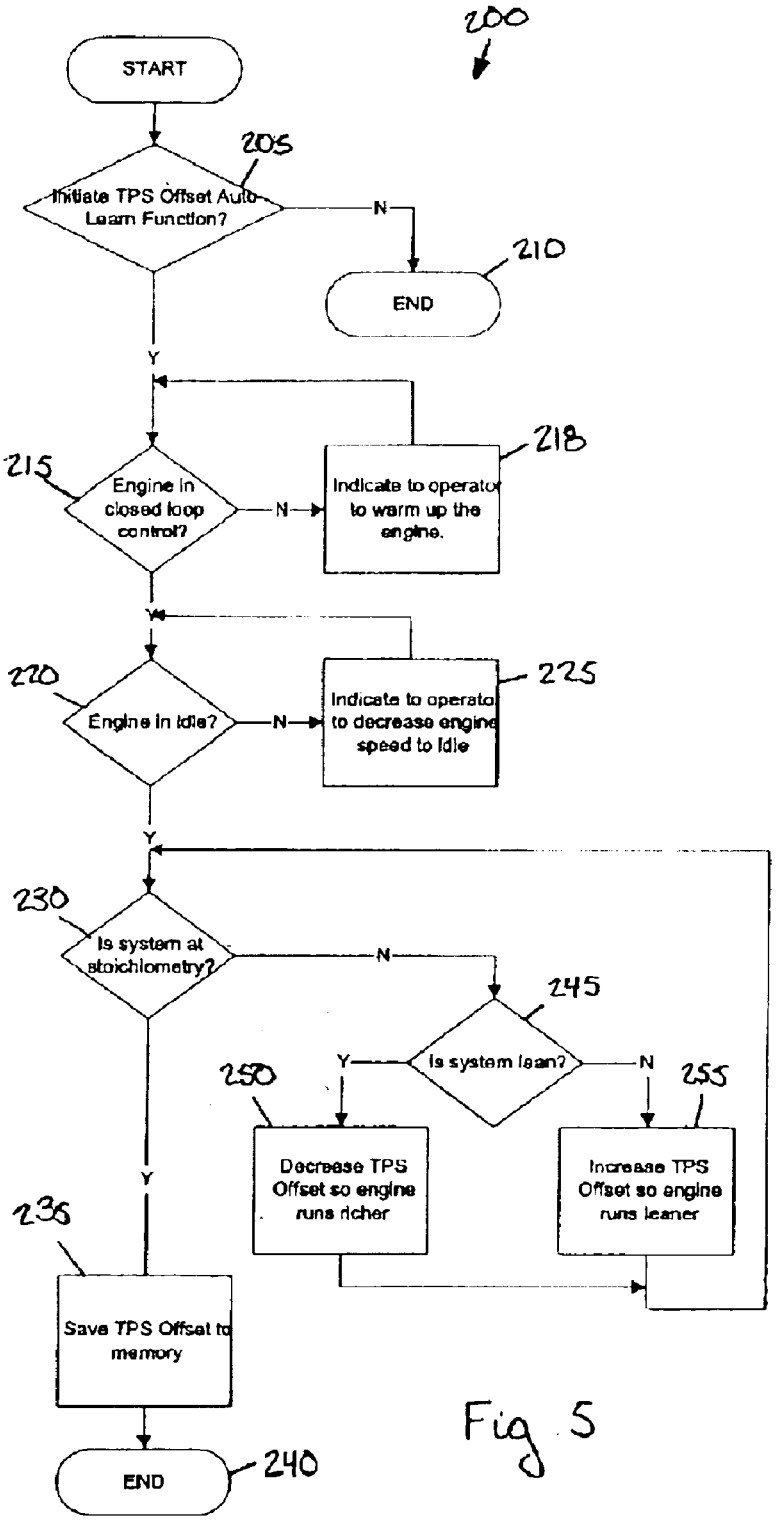
FIG. 5 is a flow diagram illustrating the operation of a fuel injection system embodying the invention.

The operation of an embodiment of the control unit 45 is illustrated by the flow diagram 200 in FIG. 5. In this embodiment, the control unit 45 performs an adjustment function for the position or angle of the throttle valve 35, as sensed and measured by the TPS 60. First, the control unit 45 must determine whether to initiate the adjustment function or the TPS offset automatic learn function as indicated at step 205. If the control unit 45 determines that the adjustment function will not be initiated, the control unit proceeds to step 210 which ends the function. If the control unit 45 initiates the adjustment function, the control unit determines if the engine 25 and the system 20 are operating in a closed-control loop. This is determined at step 215. If the control unit 45 determines at step 215 that the engine 25 is not operating in the closed-control loop, then the control unit 45 generates an indication to warm-up the engine 25 at step 218 and the control unit 45 proceeds back to step 215.

If the control unit 45 determines at step 215 that the engine 25 is operating in the closed-control loop, then the control unit, at step 220, determines whether the engine 25 is operating in idle mode. If the control unit 45 determines that the engine 25 is not in idle mode at step 220, then the control unit 45 generates an indicator to decrease the engine speed to idle at step 225. After step 225, the control unit 45 proceeds to step 220.

If the engine 25 is in idle mode at step 225, the control unit 45 performs the adjustment function for the throttle valve angle and determines the offset and corrected value for the throttle valve angle at step 230. Also at step 230, the control unit 45 determines if the engine 25 and system 20 is operating at stoichiometry. If the engine 25 is in stoichiometry at step 230, then the control unit 45 saves the throttle valve offset and the correct throttle valve angle to memory at step 235 and the function ends at step 340.

If the engine 25 is not in stoichiometry at step 230, the control unit 45 determines if the air/fuel mixture in the exhaust manifold 28 is lean at step 245. If the output by the oxygen sensor 65 indicates that the mixture is lean at step 245, the offset of the throttle valve angle is decreased at step 250. This causes the control unit 45 to send a command to the fuel injector 58 to increase the amount of fuel being dispensed. Once the offset is decreased at step 250, the control unit 45 proceeds back to step 230. If the output by the oxygen sensor 65 indicates that the mixture is not lean at step 245, the offset of the throttle valve angle is increased at step 255. This causes the control unit 45 to send a command to the fuel injector 58 to decrease the amount of fuel being dispensed. Once the offset is increased at step 255, the control unit 45 proceeds back to step 230.

In one embodiment of the invention, the output of the TPS 60 routinely or occasionally undergoes the TPS correction or adjustment function as performed by the control unit 45. The adjustment function allows the control unit 45 to determine if the engine 25 is operating at stoichiometry based on feedback from one or more sensors in the plurality of sensors. When the control unit 45 detects that the engine 25 is not operating at stoichiometry, an adjustment is made to the TPS output. The output of the TPS 60 needs to be adjusted occasionally in order for the control unit 45 to properly calculate the fueling and sparking calculations. Proper fueling and sparking calculations permits the engine 25 to operate efficiently.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A method of calculating an offset of a throttle-position sensor in an engine, the engine operable to run in an idle mode, the engine having an exhaust manifold and a fuel injection system, the fuel injection system including a control unit, a throttle valve, and at least one sensor providing an output, and operable to perform in a closed-loop mode, the method comprising:

operating the engine in idle mode;

operating the electronic fuel injection system in closed-loop mode;

computing an expected angle of the throttle valve while operating the engine in idle mode;

obtaining a first output from the at least one sensor while operating the engine in idle mode;

determining an actual angle of the throttle valve using the output from the at least one sensor;

determining an offset between the expected angle of the throttle valve and the actual angle of the throttle valve; and adding the offset to the actual angle of the throttle valve to generate a corrected angle of the throttle valve.

2. The method as set forth in claim 1, further comprising computing one of fueling and sparking calculations based on the corrected angle of the throttle valve.

3. The method as set forth in claim 1, further comprising computing both fueling and sparking calculations based on the corrected angle of the throttle valve.

4. The method as set forth in claim 1, further comprising:

obtaining a second output from a second sensor; and determining whether the engine is running at stoichiometry.

5. The method as set forth in claim 4, wherein the second sensor is an oxygen sensor.

6. The method as set forth in claim 5, wherein the oxygen sensor is substantially positioned near the exhaust manifold.

7. The method as set forth in claim 4, wherein obtaining a second output from a second sensor includes obtaining an output from a sensor measuring air-fuel mixture in the exhaust manifold.

8. The method as set forth in claim 4, wherein obtaining a second output from a second sensor includes obtaining an output from a sensor measuring air-fuel mixture in the exhaust manifold and wherein determining whether the engine is running at stoichiometry is based on the output from the second sensor measuring air-fuel mixture in the exhaust manifold.

9. The method as set forth in claim 4, further comprising computing one of fueling and sparking calculations based on the corrected angle of the throttle valve and the second output from the second sensor.

10. The method as set forth in claim 4, further comprising computing both fueling and sparking calculations based on the corrected angle of the throttle valve and the second output from the second sensor.

11. The method as set forth in claim 1, wherein the at least one sensor senses a position of the throttle valve.

12. The method as set forth in claim 1, wherein the at least one sensor is a throttle position sensor.

13. A method of performing fueling calculations for a fuel injection system in an engine, the fuel injection system capable of operating in a plurality of modes including a closed-loop mode and having a throttle valve, an exhaust manifold, and at least one sensor providing an output, the engine capable of operating in a plurality of operating modes including an idle mode, the method comprising:

computing an expected angle of the throttle valve;

determining a functioning mode of the fuel injection system;

determining an operating mode of the engine;

obtaining the output from the at least one sensor when the fuel injection system is operating in the closed-loop mode and when the engine is operating in the idle mode;

determining an actual angle of the throttle valve using the output from the at least one sensor;

determining an offset between the expected angle of the throttle valve and the actual angle of the throttle valve;

adding the offset to the actual angle of the throttle valve to result in a corrected angle of the throttle valve; and computing fueling calculations based on the corrected angle of the throttle valve.

14. The method as set forth in claim 13, further comprising computing sparking calculations based on the corrected angle of the throttle valve.

15. The method as set forth in claim 13, further comprising:

obtaining a second output from a second sensor; and determining whether the engine is operating at stoichiometry.

16. The method as set forth in claim 15, wherein the second sensor is an oxygen sensor.

17. The method as set forth in claim 16, wherein the oxygen sensor is substantially positioned near the exhaust manifold.

18. The method as set forth in claim 15, wherein obtaining a second output from the second sensor includes obtaining an output from a sensor measuring air-fuel mixture in the exhaust manifold.

19. The method as set forth in claim 15, wherein obtaining a second output from the second sensor includes obtaining an output from a sensor measuring an air-fuel mixture in the exhaust manifold and wherein determining whether the engine is operating at stoichiometry is based on the output from the second sensor measuring an air-fuel mixture in the exhaust manifold.

20. The method as set forth in claim 15, wherein determining whether the engine is operating at stoichiometry is based on the second output from the second sensor.

21. The method as set forth in claim 13, wherein the at least one sensor senses a position of the throttle valve.

22. The method as set forth in claim 13, wherein the at least one sensor is a throttle position sensor.

23. The method as set forth in claim 15, further comprising modifying the offset when the engine is not operating at stoichiometry.

24. The method as set forth in claim 23, wherein modifying the offset further includes one of increasing or decreasing the offset.

25. A fuel injection system in an engine, the system comprising:

a throttle body having a throttle valve;

a plurality of sensors, the plurality of sensors including a first sensor configured to measure a sensed throttle valve angle while the engine operates in idle mode and provide an output corresponding to the sensed throttle valve angle;

an electronic control unit coupled to the plurality of sensors and operable to receive the outputs generated by the plurality of sensors, the electronic control unit including:

a first computational module operable to derive a theoretical throttle valve angle for the engine when it is operating in idle mode;

a second computational module operable to determine a measured throttle valve angle based on the output corresponding to the sensed throttle valve angle;

a third computational module operable to determine an offset between the theoretical throttle valve angle and the measured throttle valve angle;

a summing module operable to add the offset to the measured throttle valve angle to produce a corrected throttle valve angle;

a fueling computational module operable to determine fueling calculations based on the corrected throttle valve angle; and an analyzing module operable to analyze the outputs from the plurality of sensors.

26. The system as set forth in claim 25, further comprising an exhaust manifold.

27. The system as set forth in claim 25, wherein the plurality of sensors further includes a second sensor configured to measure a sensed air-fuel mixture in the exhaust manifold and provide an output corresponding to the sensed air-fuel mixture.

28. The system as set forth in claim 26, wherein the analyzing module is further operable to determine whether the engine is operating at stoichiometry based on the output corresponding to the sensed air-fuel mixture.

29. A fuel injection system in an engine, the system comprising:

a throttle body having a throttle valve;

a first sensor configured to measure a sensed throttle valve angle when the engine operates in idle mode and provide a first output corresponding to the sensed throttle valve angle; and a control unit coupled to the first sensor, the control unit operable to receive the output generated by the first sensor, operable to compute an expected throttle valve angle, operable to determine an offset between the expected throttle valve angle and the sensed throttle valve angle, operable to determine a corrected throttle valve angle, and operable to compute fueling calculations based on the corrected throttle valve angle, the corrected throttle valve angle being based on the offset and the sensed throttle valve angle.

30. The system as set forth in claim 29, wherein the control unit is further operable to determine whether the engine is operating at stoichiometry.

31. The system as set forth in claim 30, wherein the control unit is further operable to modify the offset depending on whether the engine is operating at stoichiometry.

32. The system as set forth in claim 29 further comprising a second sensor measuring air-fuel mixture and providing a second output corresponding to the sensed air-fuel mixture.

33. The system as set forth in claim 32, wherein the control unit is further operable to determine whether the engine is operating at stoichiometry.

34. The system as set forth in claim 33, wherein the control unit is further operable to modify the offset depending on whether the engine is operating at stoichiometry.

35. The system as set forth in claim 33, wherein the control unit is further operable to determine whether the engine is operating at stoichiometry based on the second output provided by the second sensor.

36. The system as set forth in claim 35, wherein the control unit is further operable to modify the offset based on the second output provided by the second sensor.

37. The system as set forth in claim 32, wherein the control unit is further operable to modify the offset based on the second output provided by the second sensor.

38. The system as set forth in claim 32, wherein the second sensor is an oxygen sensor.

39. The system as set forth in claim 29, wherein the first sensor is a throttle position sensor.

40. The system as set forth in claim 29, wherein the control module determines the corrected throttle valve angle by adding the offset to the sensed throttle valve angle.

41. The system as set forth in claim 29, wherein the control module is further operable to compute sparking calculations based on the corrected throttle valve angle.

42. The system as set forth in claim 29, wherein the control module is further operable to determine the offset by calculating the difference between the sensed throttle valve angle and the expected throttle valve angle.

43. A fuel injection system in an engine having a parameter, the system comprising:

a first sensor configured to measure an engine parameter when the engine operates in idle mode and provide a first output corresponding to a sensed value of the engine parameter as determined by the first sensor; and a control unit coupled to the first sensor, the control unit operable to receive the output generated by the first sensor, operable to compute an expected value of the engine parameter, operable to determine an offset between the expected value of the engine parameter and the sensed value of the engine parameter, operable to determine a corrected value of the engine parameter, and operable to compute fueling calculations based on the corrected value, the corrected value being based on the offset and the sensed value.

44. The system as set forth in claim 43, wherein the control unit is further operable to determine whether the engine is operating at stoichiometry.

45. The system as set forth in claim 43 further comprising a second sensor configured to measure an air-fuel mixture and provide a second output corresponding to the sensed air-fuel mixture.

46. The system as set forth in claim 45, wherein the control unit is further operable to determine whether the engine is operating at stoichiometry.

47. The system as set forth in claim 46, wherein the control unit is further operable to modify the offset depending on whether the engine is operating at stoichiometry.

48. The system as set forth in claim 46, wherein the control unit determines whether the engine is operating at stoichiometry based on the second output provided by the second sensor.

49. The system as set forth in claim 48, wherein the control unit is further operable to modify the offset based on the second output provided by the second sensor.

50. The system as set forth in claim 45, wherein the control unit is further operable to modify the offset based on the second output provided by the second sensor.

51. The system as set forth in claim 45, wherein the second sensor is an oxygen sensor.

52. The system as set forth in claim 43, further comprising a throttle body having a throttle valve and wherein an angle of the throttle valve is the engine parameter.

53. The system as set forth in claim 52, wherein the first sensor is a throttle position sensor.

54. The system as set forth in claim 43, wherein the control module determines the corrected value of the engine parameter by adding the offset to the sensed value of the engine parameter.

55. The system as set forth in claim 43, wherein the control module is further operable to compute sparking calculations based on the corrected value of the engine parameter.

* * * * *